US006626741B2

(12) United States Patent
Wang et al.

(10) Patent No.: US 6,626,741 B2
(45) Date of Patent: Sep. 30, 2003

(54) METHOD FOR IMPROVING THICKNESS UNIFORMITY ON A SEMICONDUCTOR WAFER DURING CHEMICAL MECHANICAL POLISHING

(75) Inventors: Ting-Chun Wang, Taoyuan (TW); Kei-Wei Chen, Taipei (TW); Shih-Tzung Chang, Feng-Yuan (TW); Yu-Ku Lin, Hsin-chu (TW); Ying-Lang Wang, Tien-Chung Village (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/910,633

(22) Filed: Jul. 20, 2001

(65) Prior Publication Data

US 2003/0017784 A1 Jan. 23, 2003

(51) Int. Cl.[7] ..... B24B 1/00

(52) U.S. Cl. ..... 451/41; 451/56; 451/63; 451/60

(58) Field of Search ..... 451/41, 56, 53, 451/443, 444

(56) References Cited

U.S. PATENT DOCUMENTS 5,320,706 A * 6/1994 Blackwell ..... 438/693
5,658,185 A * 8/1997 Morgan et al. ..... 451/36
5,725,414 A * 3/1998 Moinpour et al. ..... 451/41
5,778,481 A * 7/1998 Amsden et al. ..... 15/230.16
5,876,271 A * 3/1999 Oliver ..... 451/60
5,896,870 A * 4/1999 Huynh et al. ..... 134/1.3
6,086,454 A * 7/2000 Watanabe et al. ..... 451/36
6,140,239 A * 10/2000 Avanzino et al. ..... 438/692
6,169,034 B1 * 1/2001 Avanzino et al. ..... 438/693
6,200,899 B1 * 3/2001 Fournier ..... 438/693
6,206,760 B1 * 3/2001 Chang et al. ..... 451/41
6,296,547 B1 * 10/2001 Pruet et al. ..... 451/5

* cited by examiner

*Primary Examiner*—M. Rachuba
(74) *Attorney, Agent, or Firm*—Tung & Associates

(57) ABSTRACT

A method for improving thickness uniformity on a semiconductor wafer during a chemical mechanical polishing process capable of eliminating a wafer edge collapsing defect is described. In the method, slurry solution is removed from a peripheral edge portion of less than 10 mm wide on the surface of the polishing pad such that a concentration of the slurry can be effectively reduced in the peripheral region. The reduced slurry solution leads to a reduction in the removal rate on the wafer surface. The removal of slurry from the peripheral region can further be achieved by a mechanical means. A suitable width of the peripheral region of the polishing pad to be sprayed by an edge sprayer is less than 10 mm, and preferably between about 3 mm and about 5 mm. A suitable solvent to be sprayed is deionized water.

15 Claims, 4 Drawing Sheets

METHOD FOR IMPROVING THICKNESS UNIFORMITY ON A SEMICONDUCTOR WAFER DURING CHEMICAL MECHANICAL POLISHING

FIELD OF THE INVENTION

The present invention generally relates to a chemical mechanical polishing method and more particularly, relates to a method for improving the thickness uniformity on a semiconductor wafer during a chemical mechanical polishing process.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1*a*) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results form a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($Al_3O_2$)may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

In more recently developed semiconductor fabrication technologies, the requirement of wafer global and edge planarization for inter-layer-dielectric films is gaining more importance as the size of integrated circuits is continuously reduced. In such devices, a large number of layers are stacked with low-K dielectric films for forming ultra large scale integrated circuits. In the chemical mechanical polishing of low-K dielectric films, the characteristics of within wafer non-uniformity; the difficulty to control edge profile for either the low-K films or films such as fluorinated silicate glass; and the phenomena of wafer edge collapsing in higher interlayer dielectric films directly impact the dimension of metal lines and vias and as a result, the die yield. A large deviation in critical dimension due to poor within wafer uniformity leads to the separation of vias from metal lines.

One of such typical processing problem is shown in FIGS. 2A and 2B. Wafer 28 shown in FIG. 2A was covered with a silicon oxide layer prior to a CMP process. The thickness uniformity on the wafer surface is satisfactory as shown by the relatively few contour lines. To the contrary, after wafer 28 is chemical mechanically polished, shown in FIG. 2B, the contour lines greatly increases on an edge portion 50 which is indicative of a wafer edge collapsing defect. The wafer edge collapsing defect is normally caused by a cumulation of slurry solution along the edge portion of the polishing pad and as a result, the edge of the wafer has a higher removal rate than the center portion of the wafer.

Others have addressed the wafer edge collapsing problem by adjusting different processing parameters, i.e. by using low pressure and high speed, by using metal dummy filling, by using harder polishing pad, and by designing different polishing heads. However, none of these techniques have proven to be effective in eliminating the wafer edge collapsing problem caused by the uneven polishing of a wafer surface.

It is therefore an object of the present invention to provide a method for improving thickness uniformity on a semiconductor wafer during a chemical mechanical polishing process that does not have the drawbacks or shortcomings of the conventional methods.

It is another object of the present invention to provide a method for improving thickness uniformity on a semiconductor wafer during a chemical mechanical polishing process which does not require major modification of the process equipment.

It is a further object of the present invention to provide a method for improving thickness uniformity on a semiconductor wafer during a chemical mechanical polishing process by reducing slurry concentration along a peripheral region on the polishing pad.

It is another further object of the present invention to provide a method for improving thickness uniformity on a semiconductor wafer during a chemical mechanical polishing process by removing slurry from an edge portion of a polishing pad and reducing the slurry concentration.

It is still another object of the present invention to provide a method for improving thickness uniformity on a semiconductor wafer during a chemical mechanical polishing process by spraying deionized water onto a peripheral portion of a polishing pad and removing slurry solution.

It is yet another object of the present invention to provide a method for improving thickness uniformity on a semiconductor wafer during a chemical mechanical polishing process by mounting an additional spray nozzle near the edge of a polishing pad and spraying deionized water therefrom.

It is still another further object of the present invention to provide a method for improving thickness uniformity on a semiconductor wafer during a chemical mechanical polishing process by mechanically removing slurry solution from a peripheral region of a polishing pad and thus reducing the slurry concentration in the region.

SUMMARY OF THE INVENTION

In accordance with the present invention, a method for improving thickness uniformity on a semiconductor wafer during a chemical mechanical polishing process which can be carried out by the operating steps of rotating a polishing pad with a polishing surface facing upwardly; rotating a semiconductor wafer with an active surface facing downwardly; pressing the active surface of the semiconductor wafer against the top surface of the polishing pad while dispensing simultaneously a slurry solution onto the top surface of the polishing pad; and removing the slurry from a peripheral region of less than 10 mm wide on the top surface of the polishing pad simultaneously during the pressing step to reduce a concentration of the slurry in peripheral region.

The method for improving thickness uniformity on a semiconductor wafer during a CMP process may further include the step of removing the slurry by a hydraulic means, or the step of removing the slurry by a solvent spray, or the step of removing the slurry by a water spray. The method may further include the step of removing the slurry by spraying water onto an edge portion of the wafer that is about 5 mm wide. The method may further include the step of removing the slurry by a mechanical means, such as by a squeegee. The method may further include the step of removing the slurry by a squeegee that is pressed onto an edge portion of the polishing pad to a width of about 5 mm wide. The method may further include the step of mounting a spray nozzle adjacent to each polishing pad and aiming the nozzle at an edge portion of the polishing pad.

The present invention is further directed to a method for improving polishing uniformity on a semiconductor wafer during a chemical mechanical polishing process which can be carried out by the steps of providing a polishing pad that is mounted on a rotatable platform; mounting a solvent spray nozzle juxtaposed to the rotatable platform; rotating the polishing pad with a polishing surface facing upwardly; rotating a semiconductor wafer with an active surface facing downwardly; pressing the active surface of the semiconductor wafer against the top surface of the polishing pad while dispensing simultaneously a slurry onto the top surface of the polishing pad; and spraying a solvent onto an edge portion of the polishing pad that is less than 10 mm wide such that a concentration of the slurry solution in the edge portion is reduced.

The method for improving polishing uniformity on a semiconductor wafer during a CMP process may further include the step of spraying deionized water onto an edge portion of the polishing pad to remove the slurry. The method may further include the step of spraying a solvent onto an edge portion of the polishing pad that is about 5 mm wide, or the step of spraying deionized water at a pressure of between about 5 psi and about 20 psi onto the edge portion of the polishing pad. The method may further include the step of spraying deionized water for a time period of between about 60 sec and about 180 sec onto the edge portion of the polishing pad. The method may further include the step of providing a solvent spray nozzle including a spray arm, a spray head, a spray pump and a solvent supply.

BRIEF DESCRIPTION OF THE DRAWINGS

These and other objects, features and advantages of the present invention will become apparatus from the following detailed description and the appended drawings in which.

DETAILED DESCRIPTION OF THE PREFERRED EMBODIMENT

The present invention discloses a method for improving the thickness uniformity on a semiconductor wafer during a chemical mechanical polishing process which is effective in eliminating the wafer edge collapsing defect.

The method can be carried out by conducting a chemical mechanical polishing process while engaging a rotating polishing pad to a rotating semiconductor wafer while simultaneously dispensing a slurry solution on the polishing pad surface. The slurry solution along a peripheral region of less than 10 mm wide on the surface of the polishing pad is then removed either mechanically or by a solvent flow to reduce a concentration of the slurry solution in the peripheral region of the polishing pad.

The solvent flow that is used to remove the slurry solution along the edge portion of the polishing pad can be a deionized water flow that is sprayed to a width of about 5 mm wide. The slurry solution along the edge of the polishing pad may further be removed by a mechanical means such as by a squeegee.

The method for removing slurry solution from an edge portion of the polishing pad may further be carried out by mounting a solvent spray nozzle adjacent to the polishing pad, and then spraying a solvent such as deionized water onto the edge portion of the pad that is less than 10 mm wide to reduce a concentration of the slurry solution in the edge portion. The spraying of the solvent onto the edge portion may be carried out at a water pressure between about 5 psi and about 20 psi, and preferably between about 10 psi and about 14 psi. A suitable time period for the solvent spray onto the edge portion of the pad may be between about 60 sec and 180 sec, and preferably between about 90 sec and about 120 sec.

The present invention polishing pad edge sprayer utilizes a high pressure rinse by deionized water on the edge of a polishing pad. The effective rinse of the pad edge reduces the slurry concentration and thus the removal rate in the pad edge in order to eliminate wafer edge collapsing defect. The pad edge sprayer of the present invention improves and controls the collapsing level of the wafer edge. In addition, it provides a CMP method for 8 inch or 12 inch wafers to improve wafer edge performance. Furthermore, better die yield can also be realized.

The pad edge spray system of the invention achieves a 7~10% yield improvement, and specifically, a 15% edge-die yield improvement. The edge profile can be extended to 95 mm on a 200 mm wafer, excluding a 3 mm edge. The high efficiency method for within-wafer planarization and edge profile improvement also fulfills the reduction of over 50% in via critical dimension deviations during lithography. The novel method can equally be utilized in the processing of 300 mm wafers.

Figure 1A:
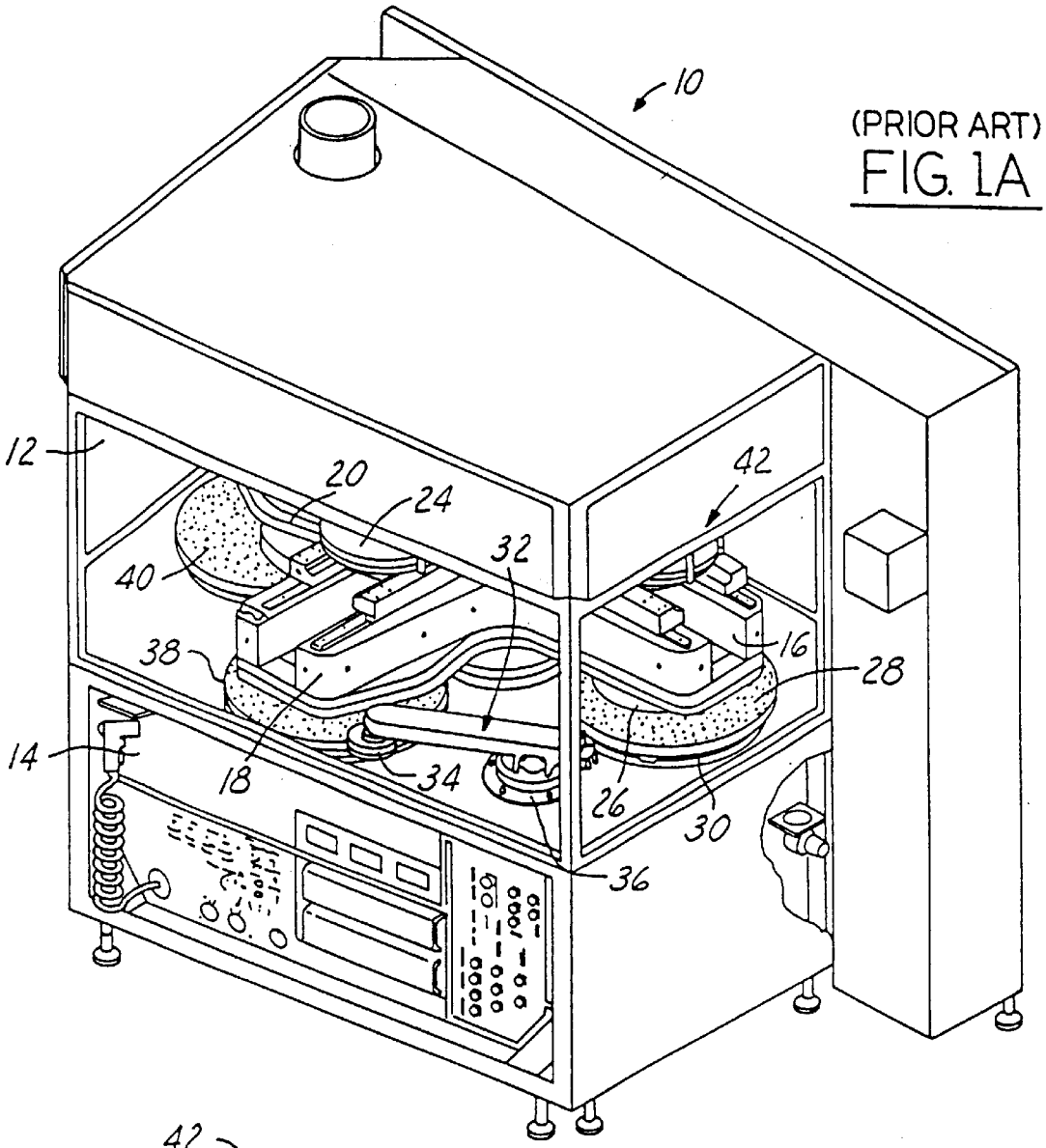
(PRIOR ART) FIG. 1A
FIG. 1A is a perspective view of a conventional chemical mechanical polishing apparatus illustrating various polishing stations.
Figure 1B:
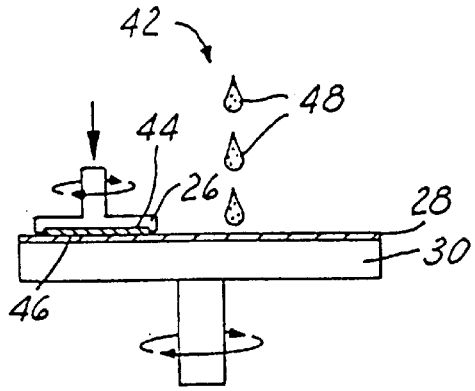
(PRIOR ART) FIG. 1B
FIG. 1B is a cross-sectional view of a polishing station on of FIG. 1A.
Figure 1C:
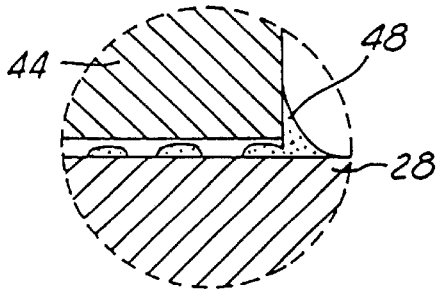
(PRIOR ART) FIG. 1C
FIG. 1C is an enlarged, cross-sectional view illustrating interaction between a wafer surface, a polishing pad and a slurry solution.
Figure 2A:
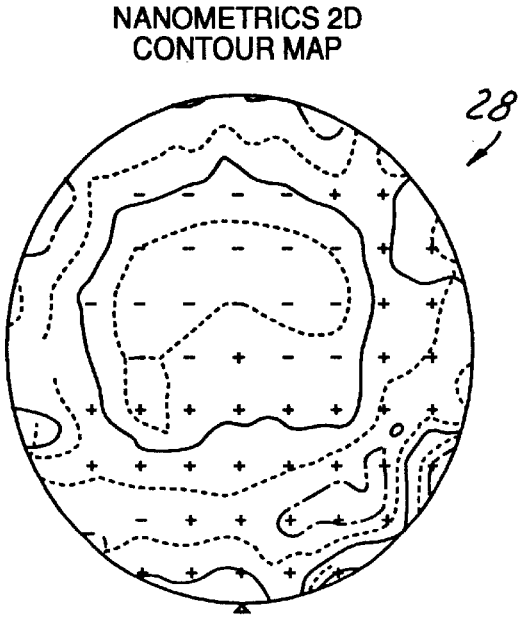
(PRIOR ART) FIG.2A
FIG. 2A is a contour map obtained on an oxide coated wafer prior to a CMP process.
Figure 2B:
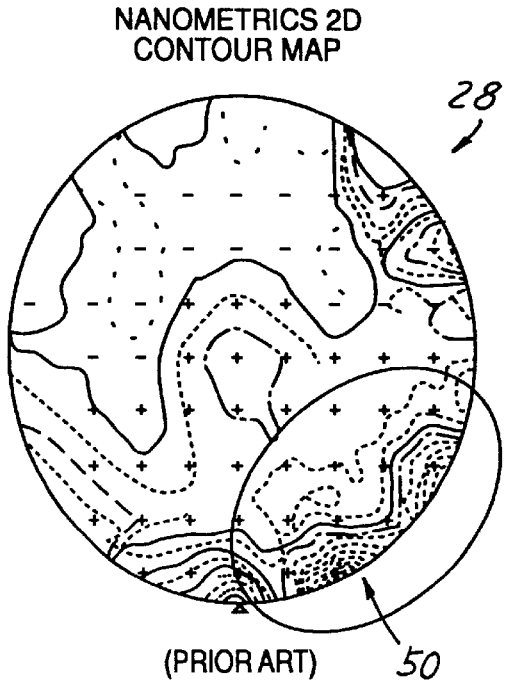
(PRIOR ART) FIG.2B
FIG. 2B is a contour map of the oxide coated wafer of FIG. 2A after a CMP process is conducted showing a wafer edge collapsing defect.
Figure 3:
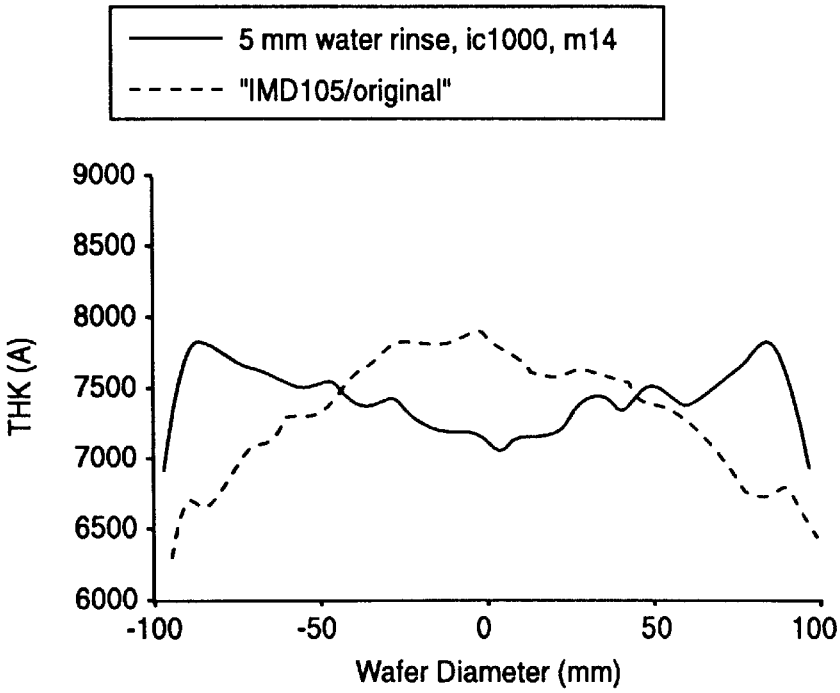
FIG. 3 is a graph showing the thickness profile over a wafer surface on wafers polished by a conventional CMP process and a present invention CMP process.

Referring now to FIG. 3, wherein a graph illustrating the effectiveness of the present invention novel method is shown. The solid trace shown in FIG. 3 is a thickness profile across a wafer obtained by spraying water of 5 mm wide on the edge portion of a polishing pad. The solid trace shows a significant improvement over that of the dashed line trace which is obtained by the conventional method.

Figure 4:
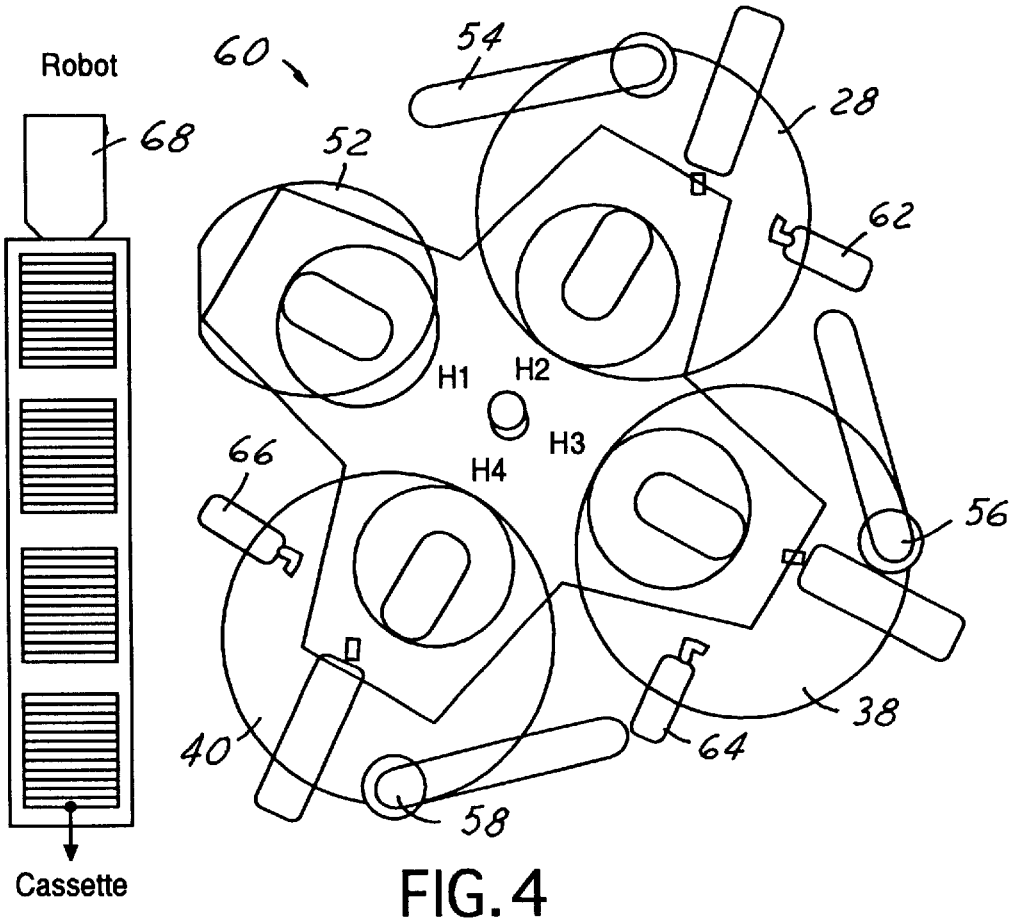
FIG. 4 is a top view of a CMP apparatus equipped with the present invention water spray nozzles for spraying the edges of the polishing pad.

The present invention novel apparatus for conducting the edge spray method is shown in FIG. 4. The apparatus 60 consists of three polishing pads 28, 38 and 40, and a loading/unloading cup 52. Adjacent to each of the three polishing pads 28, 38 and 40 is installed a pad conditioning disc 54, 56 and 58. Adjacent to the three polishing pads 28, 38 and 40 is further mounted edge sprayers 62, 64 and 66 for the spray cleaning of the polishing pad edge. The apparatus 60 is further equipped with a robot 68 for loading/unloading wafers to/from the loading cup 52.

Figure 5:
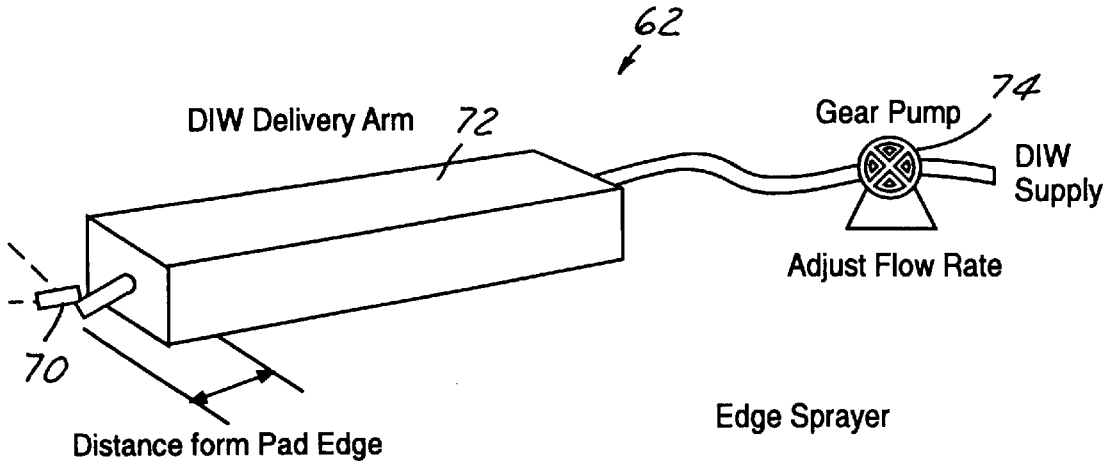
FIG. 5 is a perspective view of a present invention solvent spraying apparatus.

A perspective view of the present invention edge sprayer 62, 64 and 66 is shown in FIG. 5. The edge sprayer can be constructed of a nozzle head 70, a delivery arm 72, a gear pump 74 and a deionized water supply (not shown). The gear pump 74 is used to adjust a flow rate of the deionized water while the delivery arm 72 and the nozzle head 70 can be suitably adjusted in position for spraying only a pre-selected edge portion of the polishing pad.

Figure 6:
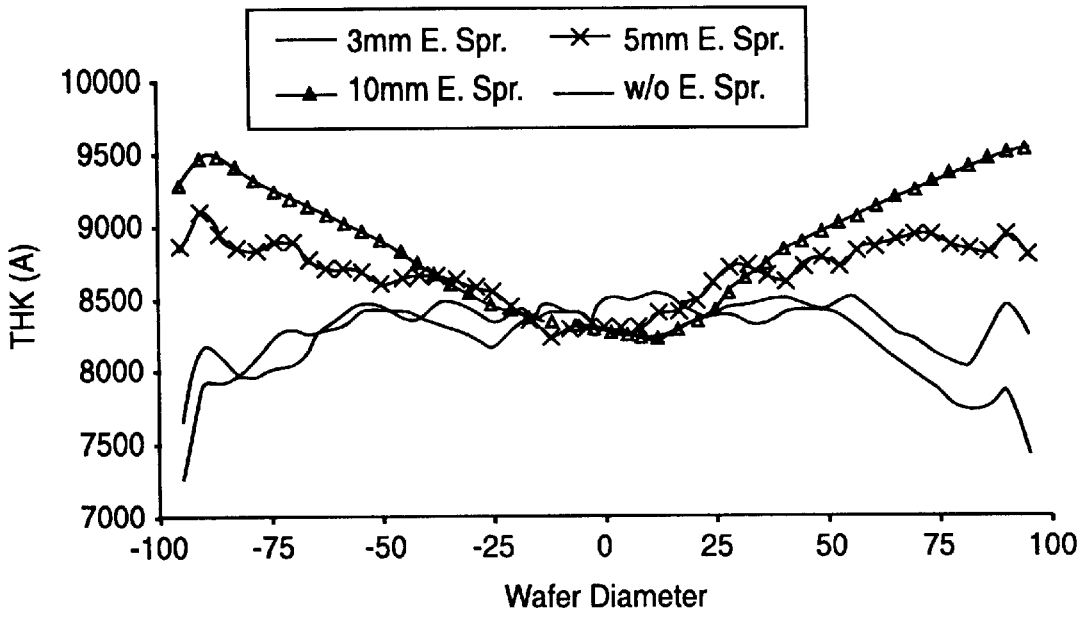
FIG. 6 is a graph illustrating various thickness profile over a wafer surface for polishing pads sprayed for various width along the edge of the pad.
Figure 7:
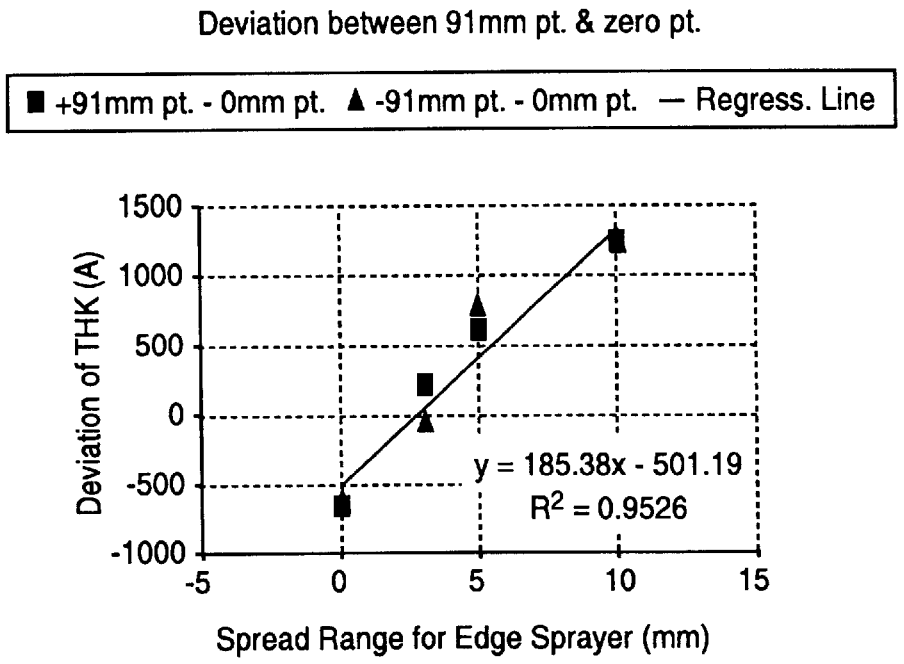
FIG. 7 is a graph illustrating the dependency of thickness uniformity on the width of the water spray on the edge of a polishing pad.

The effectiveness of the present invention novel method is shown in FIGS. 6 and 7. FIG. 6 is a graph illustrating the effect of edge spraying by the present invention novel method. The thickness contours along a wafer edge obtained for the various spraying methods are shown in FIG. 6. For instance, curve 76 is obtained by spraying a width of 10 mm along an edge portion of a polishing pad. Curve 78 is obtained by spraying a width of 5 mm along a peripheral region of a polishing pad. Curve 80 is obtained by spraying a 3 mm width along a peripheral region of a polishing pad. Curve 82 is obtained by a conventional method without any edge spraying. It is seen from FIG. 6 that the most suitable edge spraying technique is the spraying of 5 mm width, or the spraying of 3 mm width.

Similar data is obtained and shown in FIG. 7 which confirms the findings in FIG. 6 in that the 3 mm width and the 5 mm width edge spraying are the most effective in achieving uniform thickness after the chemical mechanical polishing method. FIG. 7 is obtained by plugging the deviation in thicknesses between the center of the wafer and a distance of 91 mm from the center on the width along an edge portion of a polishing pad that is sprayed.

The present invention novel method for improving thickness uniformity on a semiconductor wafer during a chemical mechanical polishing process has therefore been amply described in the above description and in the appended drawings of FIGS. 3~7.

While the present invention has been described in an illustrative manner, it should be understood that the terminology used is intended to be in a nature of words of description rather than of limitation.

Furthermore, while the present invention has been described in terms of a preferred embodiments, it is to be appreciated that those skilled in the art will readily apply these teachings to other possible variations of the inventions.

The embodiment of the invention in which an exclusive property or privilege is claimed are defined as follows.

What is claimed is:

1. A method for improving thickness uniformity on a semiconductor wafer during a chemical mechanical polishing process comprising the steps of:

rotating a polishing pad with a polishing surface facing upwardly;

rotating a semiconductor wafer with an active surface facing downwardly;

pressing said active surface of the semiconductor wafer against said top surface of the polishing pad while dispensing simultaneously a slurry onto said top surface of the polishing pad; and removing said slurry only from a peripheral region of less than 10 mm wide on said top surface of the polishing pad simultaneously during said pressing step to reduce a concentration of said slurry in said peripheral region.

2. A method for improving thickness uniformity on a semiconductor wafer during a CMP process according to claim 1 further comprising the step of removing said slurry by a hydraulic means.

3. A method for improving thickness uniformity on a semiconductor wafer during a CMP process according to claim 1 further comprising the step of removing said slurry by a solvent spray.

4. A method for improving thickness uniformity on a semiconductor wafer during a CMP process according to claim 1 further comprising the step of removing said slurry by a water spray.

5. A method for improving thickness uniformity on a semiconductor wafer during a CMP process according to claim 1 further comprising the step of removing said slurry by spraying water onto an edge portion of the wafer that is about 5 mm wide.

6. A method for improving thickness uniformity on a semiconductor wafer during a CMP process according to claim 1 further comprising the step of removing said slurry by mechanical means.

7. A method for improving thickness uniformity on a semiconductor wafer during a CMP process according to claim 1 further comprising the step of removing said slurry by a squeegee.

8. A method for improving thickness uniformity on a semiconductor wafer during a CMP process according to claim 1 further comprising the step of removing said slurry by a squeegee pressing on an edge portion of the polishing pad that is about 5 mm wide.

9. A method for improving thickness uniformity on a semiconductor wafer during a CMP process according to claim 1 further comprising the step of mounting a spray nozzle adjacent to each polishing pad and aiming the nozzle at an edge portion of the polishing pad.

10. A method for improving polishing uniformity on a semiconductor wafer during a chemical mechanical polishing process comprising the steps of:

providing a polishing pad mounted on a rotatable platform;

mounting a solvent spray nozzle juxtaposed to said rotatable platform;

rotating said polishing pad with a polishing surface facing upwardly;

rotating a semiconductor wafer with an active surface facing downwardly;

pressing said active surface of the semiconductor wafer against said top surface of he polishing pad while dispensing simultaneously a slurry onto said top surface of the polishing pad; and spraying a solvent onto an edge portion only of said polishing pad that is less than 10 mm wide such that a concentration of said slurry in said edge portion is reduced.

11. A method for improving polishing uniformity on a semiconductor wafer during a CMP process according to claim 10 further comprising the step of spraying deionized water onto an edge portion of said polishing pad to remove said slurry.

12. A method for improving polishing uniformity on a semiconductor wafer during a CMP process according to claim 10 further comprising the step of spraying a solvent onto an edge portion of said polishing pad that is about 5 mm wide.

13. A method for improving polishing uniformity on a semiconductor wafer during a CMP process according to claim 10 further comprising the step of spraying deionized water at a pressure between about 5 psi and about 20 psi onto said edge portion of the polishing pad.

14. A method for improving polishing uniformity on a semiconductor wafer during a CMP process according to claim 10 further comprising the step of spraying deionized water for a time period between about 60 sec and about 180 sec onto said edge portion of the polishing pad.

15. A method for improving polishing uniformity on a semiconductor wafer during a CMP process according to claim 10 further comprising the step of providing said solvent spray nozzle including a spray arm, a nozzle head, a gear pump and a solvent supply.

* * * * *